US005392852A

United States Patent [19]

Laurel et al.

[11] Patent Number: 5,392,852

[45] Date of Patent: Feb. 28, 1995

[54] SUB-SURFACE RELEASE PLUG ASSEMBLY WITH PRIMARY AND SECONDARY RELEASE MECHANISMS

[75] Inventors: David F. Laurel; Steven N. Rolen, both of Duncan, Okla.

[73] Assignee: Halliburton Company, Duncan, Okla.

[21] Appl. No.: 976,110

[22] Filed: Nov. 16, 1992

[51] Int. Cl.[6] ..... E21B 33/16

[52] U.S. Cl. ..... 166/153; 166/192; 166/184

[58] Field of Search ..... 166/153, 155, 156, 291, 166/242

[56] References Cited

U.S. PATENT DOCUMENTS 3,796,260 3/1974 Bradley ..... 166/153
4,809,776 3/1989 Bradley ..... 166/153
4,934,452 6/1990 Bradley ..... 166/153
4,966,236 10/1990 Braddick ..... 166/155 X
5,018,579 5/1991 Braddick ..... 166/153
5,052,488 10/1991 Fraser, III ..... 166/155

*Primary Examiner*—Ramon S. Britts
*Assistant Examiner*—Frank S. Tsay
*Attorney, Agent, or Firm*—Stephen R. Christian; J. Mike Amerson

[57] ABSTRACT

A sub-surface release plug assembly for use in cementing an outer casing annulus around a well casing comprising a top plug releasably connected to a drill string by a collet mechanism and a bottom plug releasably attached to the top plug by a sleeve assembly extending through the top plug. The assembly further comprises primary and secondary release means for releasing said plugs thereby ensuring that the plugs are released in said casing during cementing operations.

18 Claims, 5 Drawing Sheets

Fig. 8
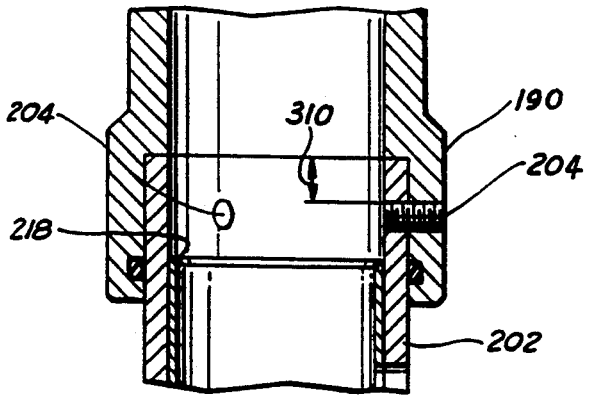
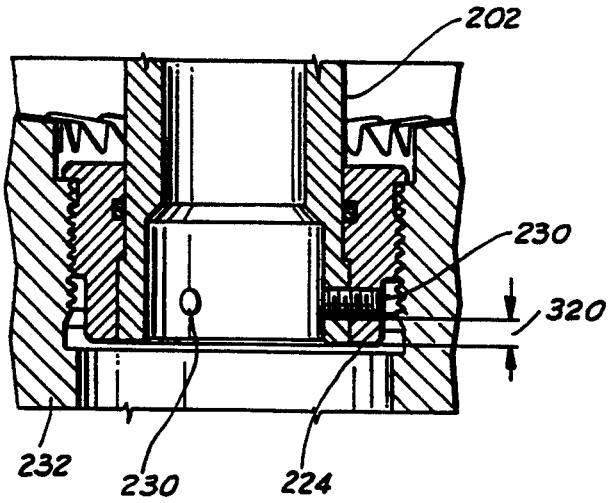
Fig. 9
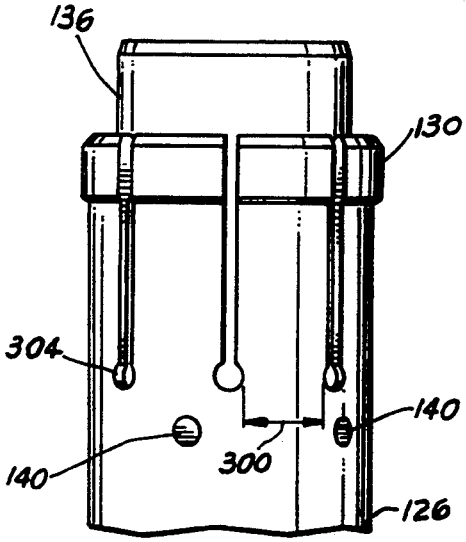
Fig. 10

SUB-SURFACE RELEASE PLUG ASSEMBLY WITH PRIMARY AND SECONDARY RELEASE MECHANISMS

Background of the invention

1. Field of the Invention

This invention relates to sub-surface release plugs used in cementing of the outer casing annulus of a well bore, and more particularly, to sub-surface release plugs having primary and secondary release mechanisms for each of the plugs, thereby insuring that should the primary release mechanism for each plug fail, release of the plugs may still be accomplished by means of the secondary release mechanism.

2. Description of the Prior Art

Typically, sub-surface release plugs positioned in the upper portion of a well casing below a casing hanger and attached to the lower end of a drill string are used in cementing operations for cementing a casing annulus adjacent a shoe joint. The construction and use of such plugs is disclosed in U.S. Pat. Nos. 4,809,776 and 4,934,452, both of which are assigned to the assignee of the present application, and both of which are hereby incorporated by reference. Another prior art sub-surface release plug system is disclosed in Halliburton Services Sales and Service Catalog 43, pages 2424–2426.

Typically, a bottom plug of the assembly is released and cement is pumped into the casing above the bottom plug, forcing the bottom plug downwardly until it comes to rest at the upper end of the shoe joint. The bottom plug seals against the inner surface of the casing so that mud below the bottom plug and cement above the bottom plug are not mixed. Once the bottom plug has reached its lowermost position, a passageway in the bottom plug is opened to allow cement to pass therethrough. The cement then passes through a float collar and/or float shoe and an opening at the lower end of the shoe joint into the casing annulus. A valve in the float collar and/or float shoe prevents reverse movement of the cement through the casing.

When the proper amount of cement has been introduced into the casing and drill string, a releasing dart or drill pipe plug is dropped into the drill string. The releasing dart engages a latching mechanism above the top plug, thus closing off the central opening of the top plug and releasing it from the drill string. The fluid pumped into the drill string forces the top plug, and the dart or drill pipe plug latched thereto, down toward the bottom plug, forcing the cement through the shoe joint. The top plug stops when it contacts the bottom plug. Once the cement has set, the top and bottom plugs are drilled out of the casing.

One problem encountered with use of previous sub-surface plug systems is that sometimes one of the plugs would not release or the passageway in the bottom plug means for the cement could not be opened. In turn, this would require that cementing operations be stopped and that the plugs and the cement be removed from the drill string. Obviously, the process of removing such a plug was very costly and time consuming and added greatly to the cost of completing a well. These and other drawbacks were the result of the failure of prior art sub-surface release plug systems to provide a primary and secondary release mechanism for the plugs, thereby ensuring that the plugs could be released in a controlled manner in the event the primary plug release mechanism failed.

SUMMARY OF THE INVENTION

The sub-surface release plug assembly of the present invention is adapted for use in a well casing and comprises upper plug means sealingly engageable with an inner surface of the well casing and releasably attachable to a drill string, lower plug means sealingly engageable with the inner surface of the well casing and releasably attached to the upper plug means, and vent means for providing venting between the drill string and the well casing at a position longitudinally between the upper and lower plug means. The apparatus provides a releasing means for releasing the lower plug means from the upper plug means in response to a first pressure in the drill string, and collet releasing means for releasably connecting the upper plug means to the drill string and releasing the upper plug means in response to a second pressure.

The apparatus further comprises primary and secondary release means for each of the upper and lower plugs and the valve means disposed in the cement passageway in the lower plug means. Through use of the sub-surface release plug system of the present invention, the release of both the lower and upper plugs can be ensured. In particular, the primary release means can be designed such that a particular plug may be released at a first predetermined pressure within said drill string. Should the plug fail to release at this primary release pressure, a secondary release mechanism is provided such that the plug may be released by increasing the pressure in the drill string to a second predetermined pressure that exceeds the first predetermined pressure. In all cases, the secondary release means is designed such that it will be activated at a pressure below the safe working pressure of the drill string and associated components, and so that the drill string may be pressurized to at least the secondary release pressure by use of cementing equipment that is routinely used in cementing operations.

Through use of the present invention, the primary and secondary release pressures for the upper and lower plug as well as the valve means disposed in the lower plug may be controlled. In fact, the secondary release pressures may be very close to the release pressures of the primary means. The particular magnitude of the various release pressures should not be considered a limitation of the present invention. Nor should the designation of particular means as "primary" and "secondary" be constructed as a particular limitation, rather, the release system could be designed such that either release means could be the primary release means.

In the preferred embodiment, the lower plug means is releasably attached to a sleeve extending through the upper plug means. The primary release means for the lower plug is comprised of a plurality of shear means interconnecting the lower plug to said sleeve. The shear means are designed to shear once a predetermined pressure has been established in the drill string, thereby releasing the lower plug to travel down the casing in advance of the cement. A secondary release means is provided for the lower plug in that the lower end of the sleeve is designed such that should the shear means not be sheared at said first pressure, an increase in the pressure in the drill string to a second pressure will cause the shear means to rip or tear through the end of the sleeve adjacent said shear means, thereby releasing the lower plug. In a preferred embodiment, the theoretical release pressure of the secondary release means is approximately twice the theoretical pressure of the primary release means.

Likewise, the valve means disposed within the cement passageway in the lower plug also has primary and secondary release means to insure that the cement passageway can be opened. In particular, the valve means is releasably attached to the lower plug by primary release means comprising a plurality of shear means interconnecting the valve means and the lower plug. The shear means are designed such that after the lower plug has landed on the float shoe or collar, they will shear at a predetermined pressure in the drill string. A secondary release means is also provided to insure the valve means is released. The secondary release means is provided in that the portion of the lower plug means to which the shear means is attached, typically a bushing in said lower plug means, is sized and designed such that should the shear means not be sheared at the first predetermined pressure, an increase in the pressure in the drill string and casing string to a second pressure will cause the shear means to rip or tear through the portion of lever plug adjacent said shear means, thereby releasing the valve means and opening the cement passageway through the lower plug. In a preferred embodiment, the theoretical release pressure of the secondary release means is approximately 1½ times the theoretical release pressure of the primary release means.

Lastly, the upper plug means of the present invention is also provided with primary and secondary release means to insure the upper plug means can be released and cementing operations can be completed. The primary release means consists of a plurality of shear means disposed circumferentially around a releasing collet that is releasably connected to the drill string. The shear means are interconnected with a releasing sleeve disposed within the collet. After a releasing dart has landed in the releasing sleeve, the pressure in the drill string may be increased to a predetermined pressure sufficient to shear the shear means interconnecting the collet and the releasing sleeve, thereby allowing the releasing sleeve to be advanced longitudinally down the collet and releasing collet fingers from engagement with the releasing sleeve, and thus freeing said upper plug means to advance down the casing string until it lands against the lower plug means. Alternatively, a secondary release means is provided for the upper plug should the shear means fail to shear at the first pressure in said drill string. In particular, the secondary release means consists of the plurality of collet fingers on the collet, each of which are sized such that the cross sectional area of the fingers will shear at a second predetermined pressure in said drill string, thereby allowing the upper plug means to descend down the casing string. In a preferred embodiment, the theoretical release pressure of the secondary release means is approximately 3 times the theoretical release pressure of the primary release means.

Additional objects and advantages of the invention will become apparent as the following detailed description of the preferred embodiment is read in conjunction with the drawings which illustrate such preferred embodiment.

BRIEF DESCRIPTION OF THE DRAWINGS

FIG. 8 shows a longitudinal cross-section of the bottom plug release mechanism.

FIG. 9 shows a longitudinal cross-section of the release mechanism for valve means disposed in the cement passageway in the lower plug, FIG. 10 shows an enlarged view of the collet release mechanism of the present invention,

DESCRIPTION OF THE PREFERRED EMBODIMENT

Figure 1:
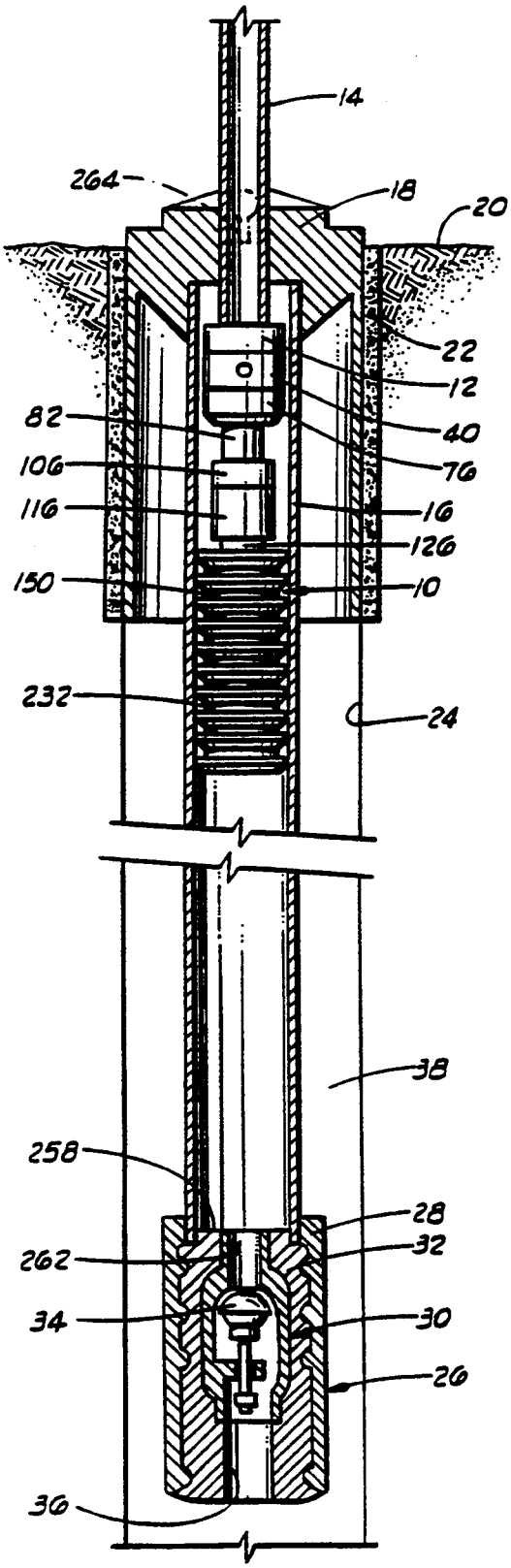
FIG. 1 shows the sub-surface release plug assembly of the present invention installed in its initial position in a well casing.

Referring now to the drawings, and more particularly to FIG, 1, the sub-surface release plug assembly of the present invention is shown and generally designated by the numeral 10. Sub-surface release plug assembly 10 has an upper adapter 12, connectable to the lower end of a drill string 14, and is positioned in a well casing 16, Well casing 16 is supported by a casing hanger or subsea well head 18 at sea floor 20. An annular concrete foundation 22 holds casing hanger 18 in place in well bore 24, Typically attached to the lower end of well casing 16 is a float shoe 26. Float shoe 26 has an outer sleeve 28 and a check valve assembly 30 held in place by a cement portion 32. Check valve assembly 30 includes a back pressure valve 34 therein.

Float shoe 26 defines a lower opening 36 therein which opens into outer casing annulus 38 between well casing 16 and well bore 24.

Float shoe 26 is of a kind known in the art, and in one alternate embodiment also known in the art, a float collar or other similar device at the upper end of a shoe joint could be used. In still another embodiment, a guide shoe having a free flow, fully open and substantially unobstructed central opening therethrough with no float collar assembly 30 could be used. Sub-surface release plug assembly 10 may be used with any of these devices, and the invention is not intended to be limited for use with the float shoe illustrated.

Figure 2A:
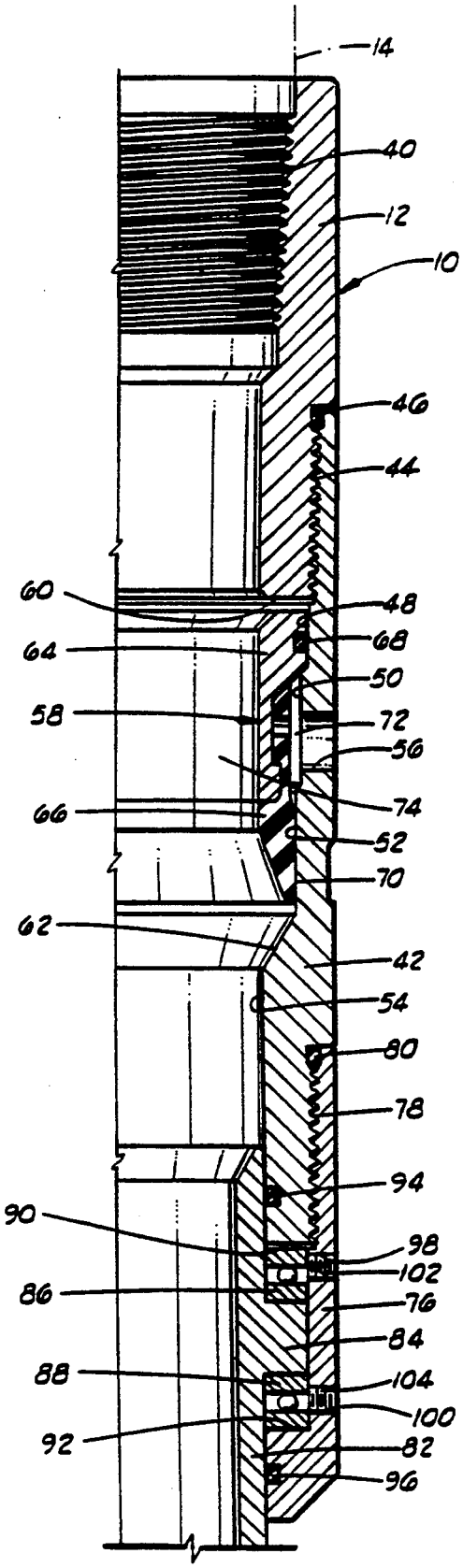
FIGS. 2A–2C show a longitudinal cross section of the sub-surface release plug in its initial position prior to release of any components thereof.
Figure 2B:
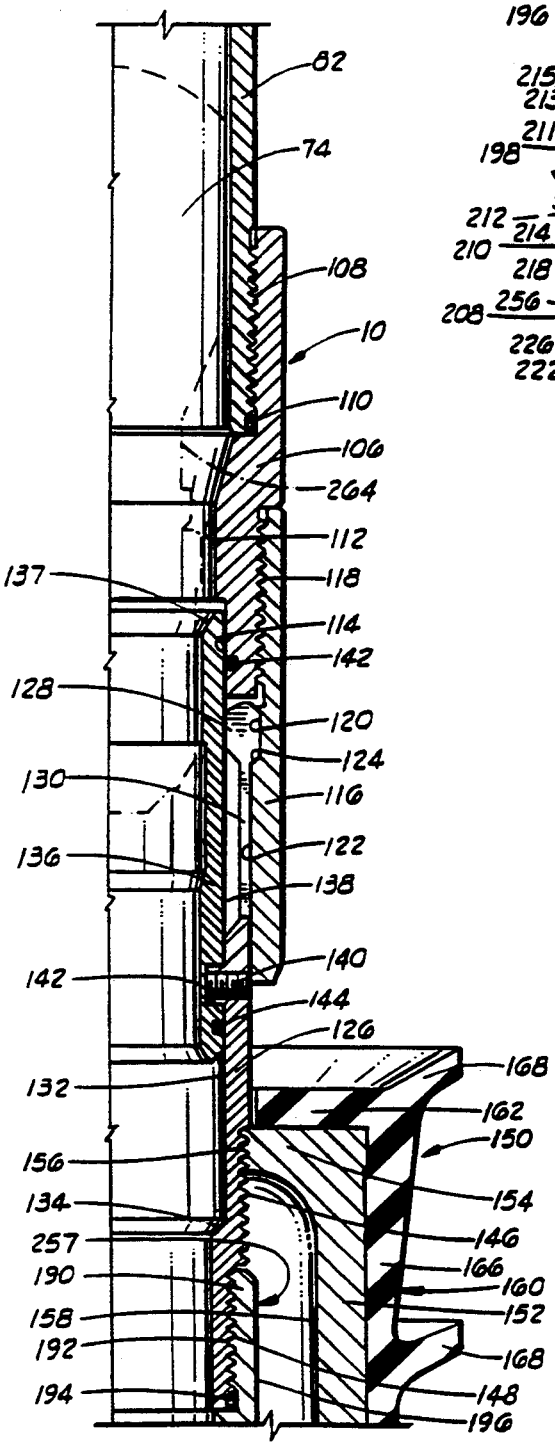
Figure 2C:
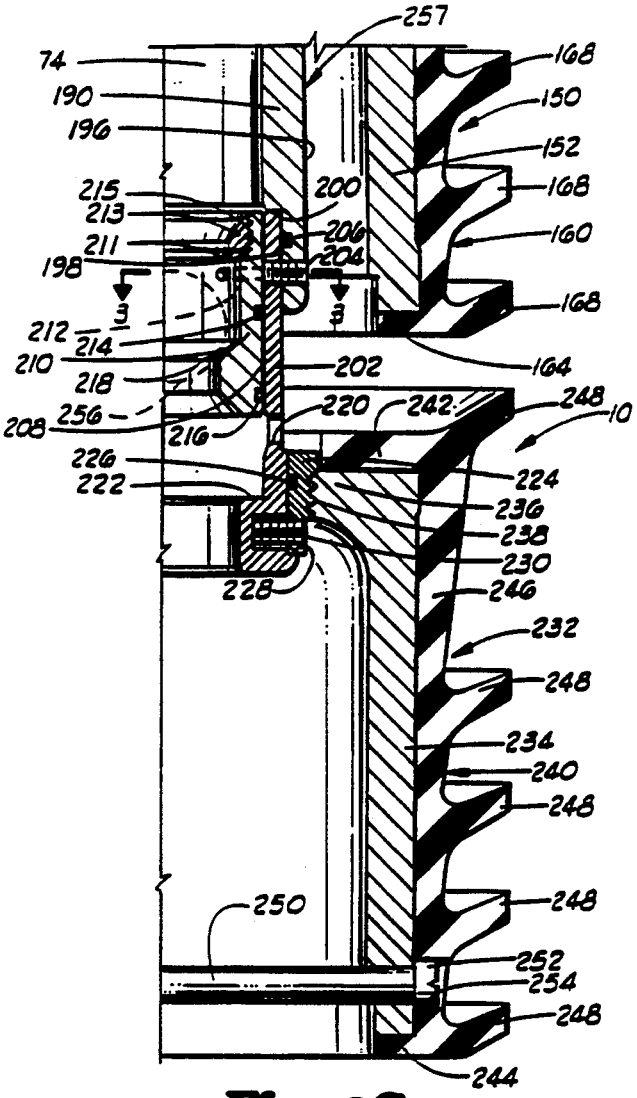

Referring now to FIGS. 2A–2C, details of sub-surface release plug assembly 10 will now be discussed. As shown in FIG. 2A, the upper end of upper adapter 12 has a threaded opening 40 therein adapted for attachment to drill string 14. The lower end of upper adapter 12 is connected to equalizer case 42 at threaded connection 44. Sealing means 46, such as an O-ring, provides sealing engagement between upper adapter 12 and equalizer case 42.

Equalizer case 42 defines a first bore 48, second bore 50, third bore 52 and fourth bore 54 therethrough. Equalizer case 42 also defines a transverse vent or equalizer opening 56 therethrough in communication with second bore 50.

A check valve means 58 is positioned in equalizer case 42 at a longitudinal location between lower end 60 of upper adapter 12 and chamfer 62 in equalizer case 42 between third bore 52 and fourth bore 54 thereof. Check valve means 58 includes a valve body 64 and a valve seal 66, made of an elastomeric material such as rubber. A sealing means 68, such as an O-ring, provides sealing engagement between valve body 64 and first bore 48 of equalizer case 42. A sealing lip 70 on valve seal 66 provides sealing engagement between the valve seal and third bore 52 of equalizer case 42. Thus, it will be seen that an annular volume 72 is defined between sealing means 58 and equalizer case 42 and is in communication with vent opening 56. It will also be seen that vent opening 56 is thus sealingly separated from central opening 74 through sub-surface release plug assembly 10. Thus, a vent means is provided wherein venting is allowed from well casing 16 to drill string 14 while venting from the drill string to the well casing is prevented.

The lower end of equalizer case 42 is attached to bearing housing 76 at threaded connection 78 with sealing means 80 providing sealing engagement therebetween.

Rotatably disposed within bearing housing 76 is the upper end of a swivel mandrel 82. Swivel mandrel 82 has a radially outwardly extending shoulder portion 84 thereon which is rotatably supported by upper ball bearing 86 and lower ball bearing 88 between lower end 90 of equalizer case 42 and upwardly facing shoulder 92 in bearing housing 76. Thus, assembly 10 includes swivel means for providing relative rotation between drill string 14 and the components below swivel mandrel 82.

Sealing means 94 provides sealing engagement between swivel mandrel 82 and fourth bore 54 of equalizer case 42 above bearings 86 and 88, and sealing means 96 provides sealing engagement between the swivel mandrel and bearing housing 76 below the bearings.

Bearing housing 76 defines a transverse hole 98 therethrough adjacent upper bearing 86 and a similar transverse hole 100 therethrough adjacent lower bearing 88. Holes 98 and 100 provide means for greasing bearings 86 and 88, respectively. Although holes 98 and 100 are shown in the same longitudinal plane in FIG. 2A, the holes are preferably angularly spaced 180°from one another. After greasing bearings 86 and 88, pipe plugs 102 and 104 are used to sealingly close holes 98 and 100, respectively.

Referring now to FIG. 2B, the lower end of swivel mandrel 82 is attached to the upper end of a lower connector 106 at threaded connection 108. Seal means 110 provides sealing engagement between swivel mandrel 82 and lower connector 106. Lower connector 106 defines a first bore 112 and a second bore 114 therethrough.

The lower end of lower connector 106 is connected to collet retainer 116 at threaded connection 118. Collet retainer 116 defines a first bore 120 and a second bore 122 therethrough with an annular, chamfered shoulder 124 therebetween.

The upper end of a collet 126 is disposed in collet retainer 116 below lower connector 106 such that the head portions 128 of a plurality of collet fingers 130 engage shoulder 124 in collet retainer 116.

Collet 126 defines a bore 132 therethrough and has a generally upwardly facing shoulder 134 at the lower end of bore 132.

A releasing sleeve 136 is slidably disposed in, and has an outer surface 138 in close spaced relationship with, second bore 114 of lower connector 106 and bore 132 of collet 126. It will also be seen that in the original position shown in FIG. 2B, releasing sleeve 136 keeps head portions 128 of collet fingers 130 engaged with shoulder 124 in collet retainer 116.

A shear means 140, such as a shear pin, is engaged with collet 126 and extends into a recess 142 in releasing sleeve 136, thus releasably holding the releasing sleeve in the original position shown in FIG. 2B.

Seal means 142 provides sealing engagement between lower connector 106 and the upper end of releasing sleeve 136 above collet fingers 130. Similarly, seal means 144 provides sealing engagement between bore 132 of collet 126 and releasing sleeve 136 below collet fingers 130. Thus, prior to actuation of releasing sleeve 136, means are provided for preventing communication between collet fingers 130 and central opening 74 of sub-surface release plug assembly 10. As will be more clearly seen hereinafter, this insures that cement and other fluids in drill string 14 do not interfere with the proper operation of collet fingers 130.

An intermediate portion of collet 126 has a first external thread 146 thereon, and the lower end of collet 126 has a second external thread 148 thereon. Preferably, second external thread 148 is smaller than first external thread 146.

A first or upper plug means 150, also referred to as a top plug means 150, is attached to collet 126 as shown in FIG. 2B, and, also referring to FIG. 2C, extends downwardly from the collet. Upper plug means 150 has a body or insert 152 with an upper, inwardly directed portion 154 which forms a threaded connection 156 with first external thread 146 of collet 126. Insert 152 has a generally cylindrical inside surface 158 below upper portion 154.

Insert 152 of upper plug means 150 is substantially surrounded by a jacket 160 bonded to the insert and preferably made of elastomeric material. Jacket 160 has an upper, inwardly directed portion 162 adjacent upper portion 154 of insert 152 and an inwardly directed lower portion 164 adjacent the lower end of insert 152. A generally longitudinal portion 166 of jacket 160 interconnects upper portion 162 and lower portion 164 thereof. Extending outwardly and angularly upwardly from longitudinal portion 166 are a plurality of wipers 168. As will be more fully explained herein, wipers 168 are adapted for sealingly engaging the inside surface of well casing 16.

In this first embodiment of the upper plug means, insert 152 is made of a relatively strong material, such as aluminum. Such material provides an adequate threaded connection 156 with external thread 146 of collet 126, and further provides adequate support for jacket 160.

Figure 4:
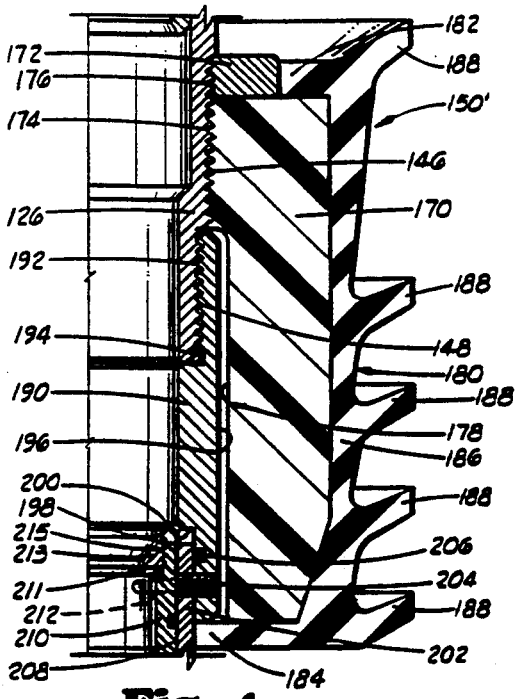
FIG. 4 is a longitudinal cross section of an alternate embodiment of the top plug of the sub-surface release plug assembly.

Referring now to FIG. 4, an alternate first or upper plug means 150' is shown attached to collet 126. Alternate upper plug means 150' includes a body or insert 170, made of a lightweight material such as plastic, with a support ring 172, made of a stronger material, such as aluminum, positioned thereabove. Insert 170 forms a threaded connection 174 with external thread 146 of collet 126, and support ring 172 forms a threaded connection 176 with external thread 146. The lower end of insert 170 has a substantially cylindrical inside surface 178 which is smaller than inside surface 158 of insert 152 in the first embodiment.

As with the first embodiment, a jacket 180, preferably made of elastomeric material, substantially surrounds and is bonded to insert 170. Jacket 180 has an upper, inwardly directed portion 182 adjacent the upper end of insert 170 and the outside diameter of support ring 172. An inwardly directed, lower portion of jacket 180 is positioned adjacent the lower end of insert 170. A longitudinal portion 186 of jacket 180 extends between upper portion 182 and lower portion 184 thereof. As with the first embodiment, a plurality of wipers 188 extend angularly upwardly and outwardly from longitudinal portion 186. Again, wipers 188 are adapted for sealing engagement with the inside surface of well casing 16.

For either upper plug means 150 or 150' the lower end of collet 126 is attached to a collet connector 190 at threaded connection 192 formed with external thread 148 on collet 126. Sealing means 194 provides sealing engagement between collet 126 and collet connector 190. It will be seen that outer surface 196 is closer to inside diameter 178 of insert 170 in alternate upper plug means 150' than inside surface 158 of insert 152 in first embodiment upper plug means 150.

Referring now to FIGS. 2C and 4, the lower end of collet connector 190 defines a bore 198 with a downwardly facing shoulder 200 adjacent thereto. Slidably positioned in bore 198 and adjacent shoulder 200 is a vent sleeve 202. Vent sleeve 202 is releasably attached to collet connector 190 by shear means 204, such as a shear pin. Seal means 206 provides sealing engagement between vent sleeve 202 and bore 198 in collet connector 190.

Figure 3:
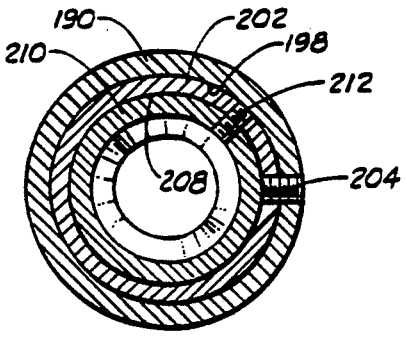
FIG. 3 is a transverse cross section taken along lines 3—3 in FIG. 2C.

Vent sleeve 202 defines an upwardly opening bore 208 in which is slidably positioned a vent valve means 210. As best shown in FIG. 3, vent valve means 210 is releasably attached to vent sleeve 202 by shear means 212. Shear means 212 is angularly spaced from shear means 204. As shown in FIG. 3, the angular displacement is approximately 45°, but the angle is not at all critical.

An elastomeric, annular gasket 211 is disposed in the upper end of vent valve means 210 above shear means 212. Gasket 211 is held in place by ring 213 which is attached to vent valve means 210 at threaded connection 215.

Upper seal means 214 and lower seal means 216 provide sealing engagement between vent valve means 210 and bore 208 in vent sleeve 202. On the inside of vent valve means 210 is an angularly disposed, annular seat 218.

Vent sleeve 202 defines a vent means, such as transverse vent opening 220, therethrough in communication with bore 208 therein. When vent valve means 210 is in the initial position shown in FIG. 2C, vent opening 220 is below lower sealing means 216.

On the inside of the lower end of vent sleeve 202 is an upwardly facing annular shoulder 222 which limits downward movement of vent valve means 210 as is hereinafter described.

Slidably disposed around an enlarged lower end of vent sleeve 202 is a bushing 224. Seal means 226 provides sealing engagement between bushing 224 and vent sleeve 202. The lower end of bushing 224 is adjacent an upwardly facing outer shoulder 228 on vent sleeve 202. Shear means 230, such as a shear pin, provides releasable attachment between bushing 224 and vent sleeve 202.

Attached to bushing 224 is a second or lower plug means 232. Lower plug means 232 includes a body or insert 234 having an upper, inwardly directed portion 236 which is attached to bushing 224 at threaded connection 238.

Substantially surrounding and bonded to insert 234 is a closely fitting jacket 240, preferably made of elastomeric material. Jacket 240 has an upper, inwardly directed portion 242 adjacent upper portion 236 of insert 234 and an inwardly directed lower portion 244 adjacent the lower end of insert 234. A substantially longitudinal portion 246 of jacket 240 interconnects upper portion 242 and lower portion 244. Extending angularly upwardly and outwardly from longitudinal portion 246 are a plurality of flexible wipers 248. As will be discussed in greater detail herein, wipers 248 are adapted for sealing engagement with the inside of well casing 16.

Extending transversely through lower plug means 232, and preferably intersecting a longitudinal center line thereof, is a catcher bolt 250. At one end of catcher bolt 250 is a head 252 which is disposed in a hole 254 of jacket 240 and engages an outer surface of insert 234. Opposite head 252 is a threaded end (not shown) of catcher bolt 250 which engages a threaded opening in the opposite side (also not shown) of insert 234.

The primary and secondary release means for the lower plug are described in more detail in FIG. 8. In particular, the primary release means comprises a plurality of shear means 204, which are typically shear pins, disposed circumferentially around the collet connector 190. The shear means 204 interconnect collet connector 190 and vent sleeve 202. The secondary release area for the bottom plug 310 is disposed on the upper end of vent sleeve 202. A secondary release means is provided for in that the upper end of vent sleeve 202 is designed and sized such that, should the shear means 204 fail to shear at a first predetermined pressure, the shear means 204 will rip or tear through the vent sleeve 202 adjacent said shear means 204 at a second predetermined pressure. The shear means 204 will remain with the collet connector 190 thereby not requiring the shear means 204 to be sheared during the valve opening.

Likewise, as more fully shown in FIG. 9, the valve means disposed in the cement passageway in lower plug means 232 also has primary and secondary release means. The primary release means is comprised of a plurality of shear means 230 disposed circumferentially around vent sleeve 202. The shear means 230 engage the vent sleeve 202 and shear pin bushing 224. The secondary release means for the valve means in lower plug means 232 is comprised of a plurality of secondary release areas 320 on the end of shear pin bushing 224 adjacent shear means 230. Should the shear means 230 fail to shear at a first predetermined pressure, the bushing 224 is designed such that shear means 230 will rip or tear through said bushing at a second predetermined pressure, thereby releasing the valve means and opening the cement passageway 260.

Lastly, as more fully shown in FIG. 10, the upper plug means release mechanism also consists of primary and secondary release means. In particular, the primary release means consist of a plurality of shear means 140 disposed circumferentially around releasing collet 126. The shear means 140 engage releasing collet 126 and releasing sleeve 136. Should the primary shear means 140 fail to release the plug, the secondary release means for the upper plug means is comprised of a plurality of collet fingers 130 manufactured so as to have a cross-sectional area, or secondary release area 300, sized so as to permit severing of the collet fingers 130 at a second predetermined pressure. In a particularly preferred embodiment, the collet fingers are provided with an enlarged space between said fingers at the point where said finger meets the remaining portion of the collet. Typically, this enlarged area is created by drilling holes 304 at the point where the fingers meet the collet base.

It will be seen that assembling sub-surface release plug assembly 10 into either a single plug or two plug configuration is a simple matter. The upper end of assembly 10 includes the collet mechanism and upper plug means 150 or 150' connected thereto. A subassembly including lower plug means 232, bushing 224, vent sleeve 202, vent valve means 210 and collet connector 190 is easily attached and detached from upper plug means 150 by making and breaking threaded connection 192. Thus, field conversion is easy and no special assembly techniques are required. The prior art subsurface release plug already described herein requires shear pin connection at all points, and thus it is extremely difficult to modify or assemble in the field. In other words, means are provided in the present invention for quickly separating lower plug means 232 from upper plug means 150 or 150' in the field.

In all cases, the primary and secondary release pressures may be predetermined and preset at a manufacturing facility. In particular, the release pressures for the shear means can be controlled by controlling the number, size and position of said shear means and tolerances on the inside diameter of the holes for said shear means and the outside diameter of said shear means. Additionally, the release pressure for the collet finger 130 may also be predetermined and preset by adjusting the spacing between the fingers such that the fingers have a cross-sectional area that will severe at a predetermined pressure within the drill string. The spacing between the fingers may be uniform or a localized enlarged space may be provided such as by drilling a hole at the base of the fingers.

OPERATION OF THE INVENTION

Sub-surface release plug assembly 10 is shown in its original position in FIG. 1. Once it is desired to begin the operation for cementing outer casing annulus 38, a ball 256 is pumped down drill string 14 in a manner known in the art. Ball 256 comes to rest on seat 218 of vent valve means 210, as shown in FIG. 2C.

The inside diameter of gasket 211 is smaller than the diameter of ball 256, but gasket 211 will deflect downwardly and outwardly enough such that ball 256 will pass by the gasket. The inside diameter of ring 213 is only slightly larger than ball 256 and provides upward support for gasket 211. In this way, gasket 211 and ring 213 provide a means for preventing upward movement of ball 256 therepast. This insures that ball 256 remains in position adjacent seat 218 of vent valve means 210.

Pressurizing drill string 14 thus pressurizes central opening 74, and at a predetermined first pressure, shear pin 212 is sheared which allows downward movement of vent valve means 210. Preferably, the pressure is approximately 300 psi. Vent valve means 210 will move downwardly until it comes to rest against shoulder 222 and vent sleeve 202, and it will be seen that upper and lower seal means 214 and 216 will sealingly isolate vent opening 220 from central opening 74.

The lower end of collet 126, collet connector 190, vent sleeve 202 and bushing 224 may be said to form an inner sleeve means 257 extending through upper plug means 150 to which lower plug means 232 is connected. It will be seen that the pressure in central opening 74 in inner sleeve means 257 is not exerted on inside surface 158 of upper plug means 150 or inside surface 178 of alternate upper plug means 150'. Thus, a means is provided for preventing a bursting pressure from being applied to upper plug means 150, and hard, high strength materials are not required. Accordingly, low strength materials, even including plastic as in the alternate embodiment 150' may be used in the upper plug means which allows easier drilling as will be described in more detail hereinafter. Finally, it should also be obvious that inner sleeve means 257 also acts as a means for preventing pressure in central opening 74 from being applied to the inside of lower plug means 232 because ball 256 substantially seals against seat 218.

In operation, the incorporation of the primary and secondary release means for the upper and lower plugs and the valve means disposed in the lower means will insure that the various components are in fact released and cementing operations can continue without necessitating the cost and expense of ceasing cementing operations while a plug that failed to release is removed.

Figure 5:
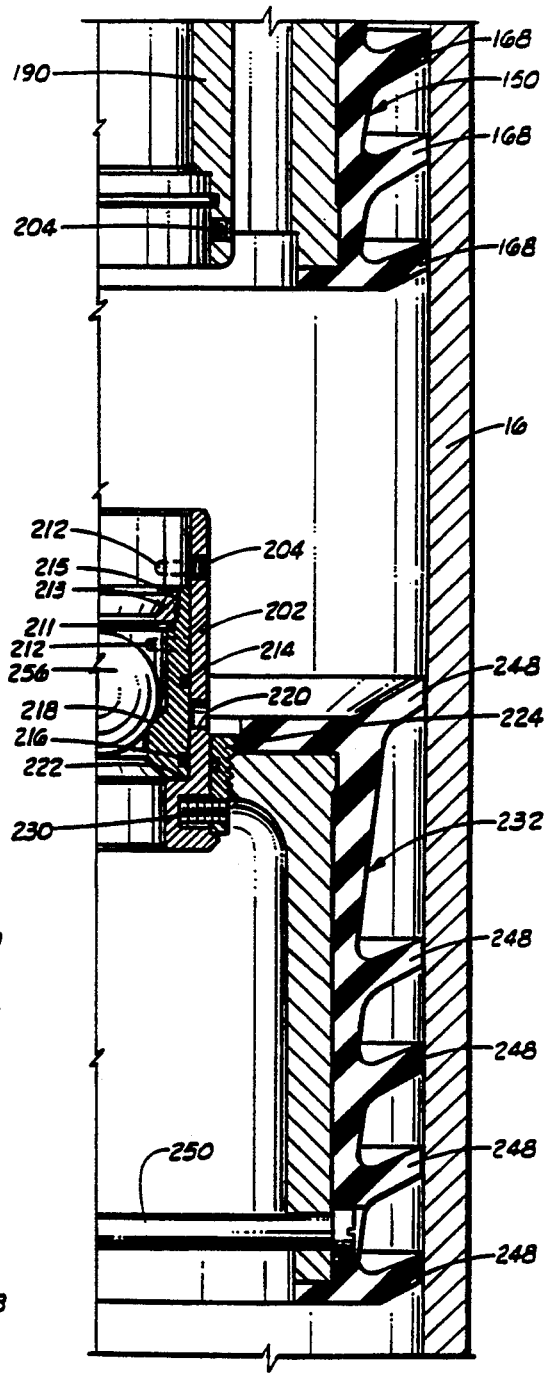
FIG. 5 is a longitudinal cross section showing the lower plug immediately after being released from the top plug.
Figure 6:
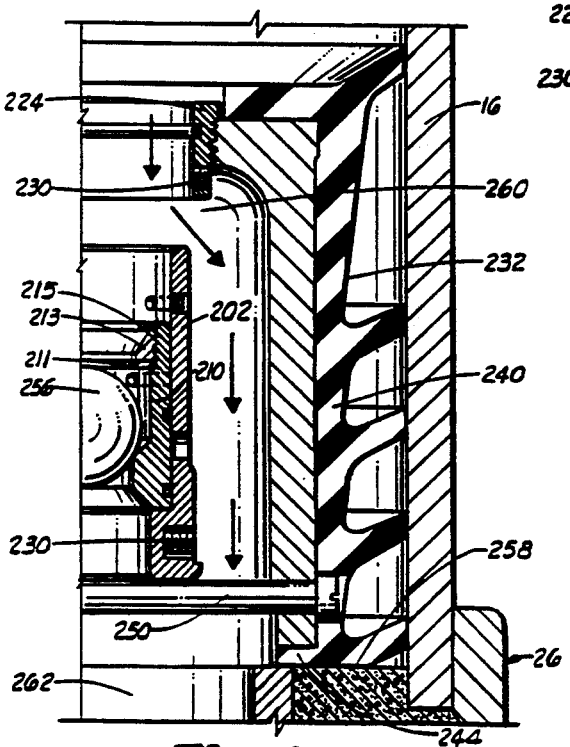
FIG. 6 illustrates a longitudinal cross section of the lower plug at the bottom of the well casing and with a flow valve therein in an open position.

Referring now to FIG. 5, additional pressure may be applied to central opening 74 through drill string 14 such that the primary plug release means for the lower plug, shear pin 204, is sheared. Should the shear means 204, typically shear pins, disposed between collet connector 190 and vent sleeve 202 fail to shear, then the secondary release area 310 formed in the upper end of vent sleeve 202 adjacent shear means 204, will allow the lower plug means to be released. More particularly, if the primary shear means 204 fail to shear at an initial pressure, the secondary release area 310 can be designed such that the shear pins will rip through the upper portion of vent sleeve 202, thereby releasing the lower plug. In either case, vent sleeve 202 is released from collet connector 190 which, of course, releases lower plug means 232 from upper plug means 150 or 150'. Lower plug means 232 is therefore free to travel downwardly through well casing 16 towards float shoe 26.

Cement pumped from the surface down through drill string 14 will force lower plug means 232 thus to move downwardly in well casing 16, and wiper rings 248 will wipe the inside surface of well casing 16 free of the drilling mud or other fluids that were already present therein and sealingly separate the mud from the cement above lower plug means 232. Eventually, lower plug means 232 will come to rest against inside, upper surface 258 of float shoe 26. Lower portion 244 of jacket 240 will provide sealing engagement between lower plug means 232 and upper surface 258.

Likewise, after the lower plug means 232 has come to rest against float shoe 26, it is necessary to open fluid passageway 260 and thereby allow cement to flow through the float shoe 26 into the annular spacing adjacent the well casing. When the lower plug means 232 reaches the float shoe 26, pressure is increased in the drill string until the primary release means, shear means 230, is sheared which thereby allows vent sleeve 202 and vent valve means 210 to fall downwardly within the lower plug means 232 until stopped by catcher bolt 250. Alternatively, should primary release means, shear means 230, fail to shear, the lower end of shear pin bushing 224 is sized and designed such that at a second pressure, the shear means 230 will rip through the shear pin bushing material 224 adjacent to the shear means 230, thereby allowing vent sleeve 202 and vent valve means 210 to fall downwardly within lower plug means 232. Thus, by inclusion of primary and secondary release means, it can be insured that vent sleeve 202 and vent valve means 210 can be downwardly displaced within lower plug 232, thus opening fluid passageway 260 and allowing cement to flow out float shoe 226 and into the annular space between the well bore and the casing. Thus, a valve means is provided whereby a fluid passageway 260 is formed through lower plug means 232, providing fluid communication between well casing 16 above the lower plug means and an inlet opening 262 in float shoe 26. Referring once again to FIG. 1, back pressure valve 34 will be opened by the pressure so that the cement will flow from well casing 16 through lower opening 36 in float shoe 26 and into outer casing annulus 38.

After the desired amount of cement has been pumped through the system, pumping is ceased by the operator. At this point, it is desired to release upper plug means 150 or 150' and pump it downwardly through well casing 16 to displace all of the cement therebelow through float shoe 26 so that no cement will set within well casing 16. To release upper plug means 150 or 150', a releasing dart or drill pipe plug 264 is pumped down drill string 14 as shown in FIG. 1. The upper plug release mechanism disclosed and claimed herein also comprises primary and secondary release means. The primary release means comprises shear means 140 disposed circumferentially around releasing collet 126. Shear means 140 are engaged with releasing sleeve 136 and releasing collet 126. The secondary release means consists of a plurality of collet fingers 130 disposed circumferentially around releasing collet 126. The primary release means will be actuated when releasing dart 74 is disposed within releasing sleeve 136 and pressures increase sufficient to shear means 140. Should shear means 140 not be sheared at a first release pressure, an increase in pressure will result in a tension being applied to collet fingers 130. The secondary release means for the upper plug consists of collet fingers 130 having a cross-sectional area such that the collet fingers 136 will fail at a second predetermined pressure above the pressure which the shear means 140 would be expected to fail. Thus, upper plug means 150 is free to descend down the drill string in that releasing sleeve 136 and the releasing collet 126, less collet fingers 130, is free to fall from the drill string.

Releasing dart or drill pipe plug 264 is of a kind known in the art and as designed to sealingly engage the inside surface of drill string 14 and to sealingly close central opening 74 in sub-surface release plug assembly 10. As shown in FIG. 2B, plug 274 engages chamfered shoulder 137 in releasing sleeve 136. Drill string 14 is raised to a predetermined second pressure which is applied above plug 264 causing a downward force on releasing sleeve 136 sufficient to shear the primary releasing means for the upper plug, shear means 140. Releasing sleeve 136 is forced downwardly until it engages chamfered shoulder 134 in collet 126. In this downwardmost position of releasing sleeve 136, collet fingers 130 and head portions 128 thereof are freed for radially inward movement. Additional pressure in drill string 14 will then cause head portions 128 of collet fingers 130 to disengage from shoulder 124 in collet retainer 116. Thus, primary releasing means are provided for releasing upper plug means 150 or 150' for subsequential downward movement through well casing 16. Alternatively, as discussed above, collet fingers 130 provide a secondary release means for releasing the upper plug means should shear means 140 fail to shear.

A similar collet mechanism having primary and secondary release means could be used in attaching lower plug means 232 to upper plug means 150 or 150' rather than the shear means 204 already described. In other words, vent sleeve 202 could be constructed with collet fingers thereon. In this embodiment, vent valve means 210 would also provide sealing of the collet mechanism prior to movement thereof by ball 256. Simultaneously with the release of the collet fingers in this embodiment, vent opening 220 would be closed by vent valve means 210.

Figure 7A:
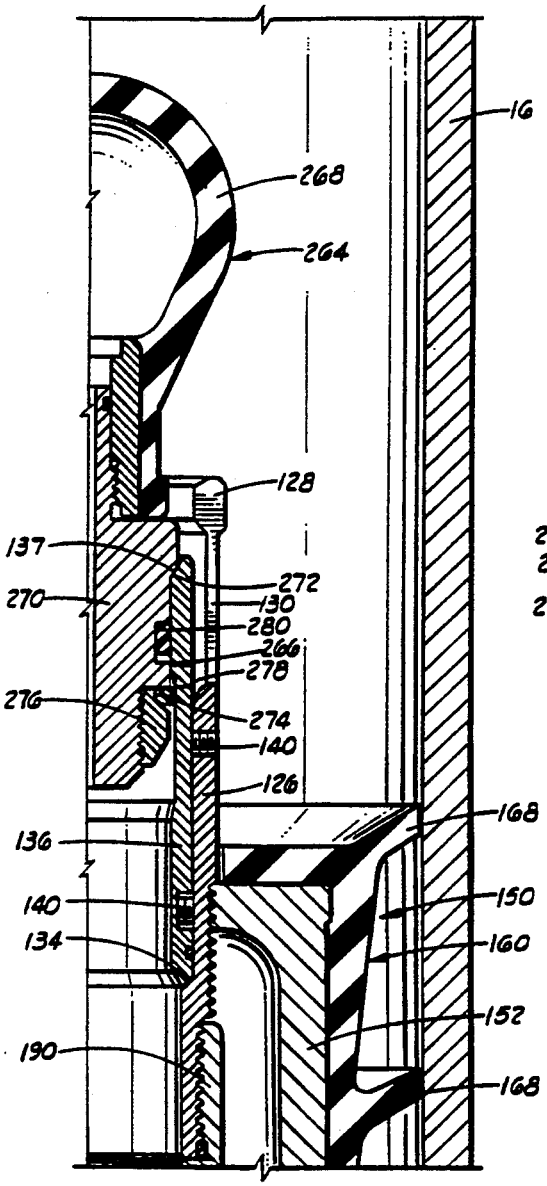
FIGS. 7A and 7B show a longitudinal cross section of the sub-surface release plug assembly after release of the upper plug wherein the top plug is engaged with the bottom plug at the lower end of the well casing.
Figure 7B:
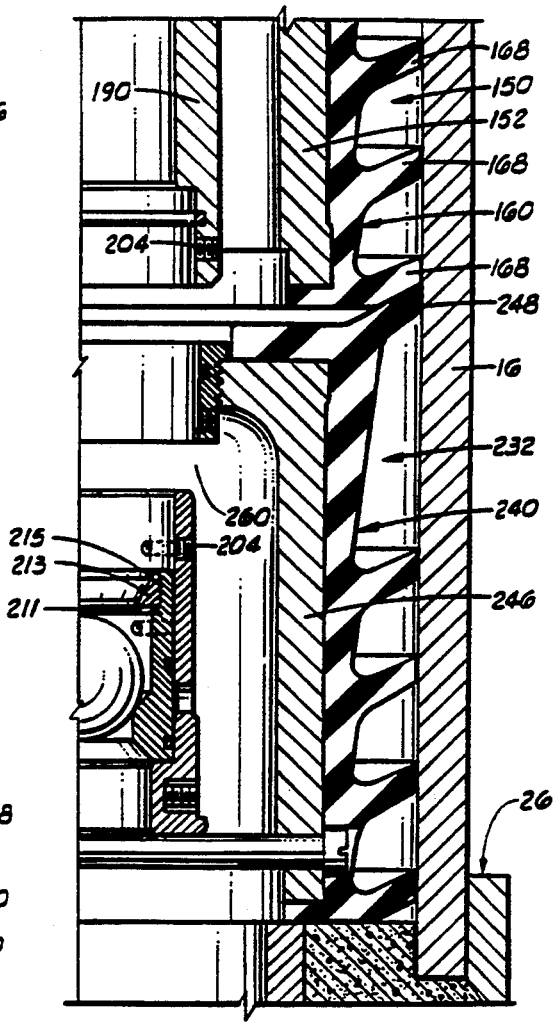

Referring now to FIGS. 7A and 7B, released upper plug means 150 is shown after being moved downwardly through well casing 16 where it is in contact with lower plug means 232. Plug 264 is illustrated with a latching nose 266 connected to an elastomeric body 268. Latching nose 266 includes a mandrel portion 270 having a shoulder 272 thereon which contacts shoulder 137 in releasing sleeve 136. A snap ring 274, disposed between a retainer 276 and mandrel portion 270 is adapted to expand outwardly so that upward movement of plug 264 is prevented by shoulder 278 in releasing sleeve 136. Seal means 280 provides sealing engagement between mandrel portion 270 and releasing sleeve 136. As clearly seen in FIG. 7A, collet fingers 130, and head portions 128 thereof, are completely free.

A releasing dart having wipers rather than a bulbous body 228 could also be used. Such releasing dart would preferably have similar attaching means such as latching nose 266.

As upper plug means 150 or 150' is pumped downwardly through well casing 16, the cement therebelow is displaced outwardly through float shoe 26 into outer casing annulus 38. When upper plug means 150 reaches the lowermost position, the lowermost wiper on jacket 160 thereof sealingly engages the uppermost wiper 248 on jacket 240 of lower plug means 232. Similarly, with alternate upper plug means 150', the lowermost wiper ring 188 would engage the uppermost wiper 248.

After the cement has set, plug 264, upper plug means 150 or 150' and lower plug means 232 are drilled out of casing 16 so that the well can be operated in production. Obviously, because of the construction of sub-surface release plug assembly 10 wherein pressure is not applied to the inner portions of the upper and lower plug means themselves, the correspondingly softer materials of insert 152 in upper plug means 150 and insert 234 of lower plug means 232 facilitate drilling. Plastic insert 170 of alternate upper plug means 150' provides an even greater advantage, although either embodiment is far superior to the hard materials required in the sub-surface release plugs of the prior art.

It can be seen, therefore, that the sub-surface release plug assembly of the present invention having primary and secondary release means for releasing the plugs is well adapted to carry out the ends and advantages mentioned as well as those inherent therein. While presently preferred embodiments of the invention have been shown for the purposes of this disclosure, numerous changes in the arrangement and construction of parts may be made by those skilled in the art. All such changes are encompassed within the scope and spirit of the appended claims.

What is claimed is:

1. A subsurface release apparatus for use in a well casing, said apparatus comprising:

an upper plug means for releasably connecting to a drill string by a first releasing mechanism;

a lower plug means for releasably attaching to said upper plug means; and said first releasing mechanism comprising a first release means actuatable at a first predetermined pressure in said drill string and a second release means actuatable a second predetermined pressure in said drill string.

2. A subsurface release apparatus for use in a well casing, as recited in claim 1, wherein said first releasing mechanism comprises a collet having a plurality of collet fingers and a slidable releasing sleeve disposed within said collet.

3. A subsurface release apparatus for use in a well casing, as recited in claim 2, wherein said first release means comprises at least one shear means interconnecting said slidable releasing sleeve and said collet, said shear means being severable at said first predetermined pressure in said drill string.

4. A subsurface release apparatus for use in a well casing, as recited in claim 2, wherein said second release means comprises said plurality of collet fingers having a cross-sectional area such that said fingers will sever from said collet at said second predetermined pressure in said drill string.

5. A subsurface release apparatus for use in a well casing, as recited in claim 1, further comprising a second releasing mechanism releasably connecting said lower plug means to a sleeve extending through said upper plug means, said second releasing mechanism comprising a third release means actuatable at a third predetermined pressure in said drill string and a fourth release means actuatable at a fourth predetermined pressure in said drill string.

6. A subsurface release apparatus for use in a well casing, as recited in claim 5, wherein said third release means comprises at least one shear means interconnecting said sleeve and said lower plug, said shear means being severable at said third predetermined pressure in said drill string.

7. A subsurface release apparatus for use in a well casing, as recited in claim 5, wherein said fourth release means comprises a rupturable area of said releasing sleeve adjacent each of said shear means such that said shear means will rupture said releasing sleeve at a fourth predetermined pressure in said drill string.

8. A subsurface release apparatus for use in a well casing, as recited in claim 5, further comprising a third releasing mechanism releasably connecting a valve means to said lower plug means comprising a fifth release means actuatable at a fifth predetermined pressure in said drill string and a sixth release means actuatable at a sixth predetermined pressure in said drill string.

9. A subsurface release apparatus for use in a well casing, as recited in claim 8, wherein said fifth release means comprises at least one shear means interconnecting said valve means and a bushing disposed in said lower plug means, said shear means being severable at a fifth predetermined pressure in said drill string.

10. A subsurface release apparatus for use in a well casing, as recited in claim 9, wherein said sixth release means comprises a rupturable area of said bushing adjacent each of said shear means such that said shear means will rupture said bushing at a sixth predetermined pressure in said drill string.

11. A subsurface release apparatus for use in a well casing, said apparatus comprising:

an upper plug means for releasably connecting to a drill string by a first releasing mechanism;

a lower plug means for releasably attaching said upper plug means by a second releasing mechanism; and each of said first and second releasing mechanisms comprising a primary releasing means and a secondary releasing means.

12. A subsurface release apparatus for use in a well casing, as recited in claim 11, wherein said primary releasing means comprises at least one shear means releasably connecting said upper plug means to said drill string and releasably connecting said lower plug means to said sleeve extending through said upper plug means, said shear means being severable at predetermined pressures in said drill string.

13. A subsurface release apparatus for use in a well casing, as recited in claim 12, wherein said secondary releasing means comprises a portion of said first and second release mechanisms that is rupturable at predetermined pressures in said drill string.

14. A subsurface release apparatus for use in a well casing, as recited in claim 13, wherein said first releasing mechanism comprises a collet having a plurality of collet fingers and a slidable releasing sleeve disposed within said collet.

15. A subsurface release apparatus for use in a well casing, as recited in claim 13, wherein said second releasing mechanism is comprised of a sleeve extending through said upper plug means, said lower plug means being releasibly connected to said sleeve.

16. A subsurface release apparatus for use in a well casing, as recited in claim 11, further comprising a releasable valve means disposed within said lower plug means, said releasable valve means comprising primary and secondary release means.

17. A subsurface release apparatus for use in a well casing, as recited in claim 16, wherein said primary release means for said valve means comprises at least one shear means releasably connecting said valve means to said lower plug.

18. A subsurface release apparatus for use in a well casing, as recited in claim 17, wherein said secondary release means for said valve means comprises a shear means connecting said valve means to a bushing disposed in said lower plug means, said bushing being rupturable by said shear means at a second predetermined pressure.

* * * * *

UNITED STATES PATENT AND TRADEMARK OFFICE

CERTIFICATE OF CORRECTION

PATENT NO. : 5,392,852

DATED : February 28, 1995

INVENTOR(S) : Laurel et al.

It is certified that error appears in the above-indentified patent and that said Letters Patent is hereby corrected as shown below:

Column 9, line 39, delete "severe" and insert --sever-- therefore .

Column 11, line 11, delete "226" and insert --26-- therefore.

Column 13, line 13, after "actuatable", insert --at--.

Signed and Sealed this

Twenty-fourth Day of October, 1995

*Attest:*

*Attesting Officer*

Bruce Lehman

BRUCE LEHMAN

*Commissioner of Patents and Trademarks*